United States Patent [19]

Frenger

[11] 4,220,016

[45] Sep. 2, 1980

[54] SKIN JEWELRY

[76] Inventor: Rita K. Frenger, 5409 Old Dover Blvd., Fort Wayne, Ind.

[21] Appl. No.: 662,123

[22] Filed: Feb. 27, 1976

[51] Int. Cl.[2] ..... A44C 17/00

[52] U.S. Cl. ..... 63/2; 63/DIG. 1; 63/32

[58] Field of Search ..... 63/DIG. 1, 2, 23, 32, 63/29 R

[56] References Cited

U.S. PATENT DOCUMENTS

| | | | |
|---|---|---|---|
| 439,139 | 10/1896 | Gaynor | 63/23 |
| 1,140,975 | 5/1915 | Frankel | 63/DIG. 1 |
| 2,145,071 | 1/1939 | Cave | 63/2 |
| 2,220,038 | 10/1940 | Kreisler et al. | 63/23 X |
| 2,596,965 | 5/1952 | Troy | 63/32 X |
| 2,633,440 | 3/1953 | Scholl | 63/DIG. 1 |
| 2,975,538 | 3/1961 | Murfin | 63/DIG. 1 |
| 3,802,945 | 4/1974 | James | 63/32 X |
| 3,831,398 | 8/1974 | Davis | 63/2 |

FOREIGN PATENT DOCUMENTS

| | | | |
|---|---|---|---|
| 2152412 | 4/1973 | Fed. Rep. of Germany | 63/32 |

*Primary Examiner*—F. Barry Shay
*Attorney, Agent, or Firm*—David A. Lundy

[57] ABSTRACT

Decorative jewelry which may be worn on the skin of the wearer. The jewelry has a decorative portion and a flexible and resilient pad secured to the back side of the decorative portion by which the jewelry is attached to the skin of the wearer. The decorative portion, in specific embodiments, may be a precious stone or an artificial stone or a look-alike, which in one embodiment changes color in response to the amount of body heat transferred from the wearer.

6 Claims, 2 Drawing Figures

SKIN JEWELRY

BACKGROUND OF THE INVENTION

1. Field of the Invention

The invention relates generally to jewelry, and particularly, to jewelry which can be worn on the skin of the wearer and to costume jewelry of the same type which has the ability to change color in response to the amount of body heat transferred to the jewelry.

2. Description of the Prior Art

The prior art most closely related to the invention is the many varied forms of jewelry heretofore known and the specific class of costume jewelry known as "mood rings". This class of decorative jewelry is a ring having a decorative artificial stone with the capacity to change color in response to the amount of heat transferred to the stone from the wearer. While various forms of jewelry have been commercially marketed in the past, they do possess limiting characteristics. In general, rings are relatively expensive. This is due, for the most part, to the ornate settings in which the stone, whether a precious stone or an artificial stone or the like, is set. The same can be said for the settings of brooches, pins or the like having precious stones, artificial stones or look-a-likes as the decorative portion thereof.

Further, rings are limited in that the only place the wearer can wear the ring is on one of his fingers. Similarly, brooches or the like can only be pinned to clothing or depended from a necklace or the like.

It would be highly desirable to provide jewelry which by the means of attachment could be provided relatively inexpensively. Further, it is believed that certain persons for certain occasions would wear jewelry on various parts of their body; for example, on the cheek, on the forehead, on the arm, on the abdomen, in the navel, or on the thigh. Heretofore, there has been no practical way to attach jewelry to the skin of the wearer. If one attempted to apply an adhesive to a brooch (with the pin removed) or to a stone of a conventional ring and attach the same to the skin of the wearer, an inadequate bond between the jewelry and the skin would result. Further, the wearer would in all probability be uncomfortable where the jewelry was attached. This, for the most part, would be caused by the flexible nature of the human skin and the inability of the jewelry to flex.

Even though costume jewelry is relatively inexpensive as compared to jewelry decorated with precious stones, it is still disconcerting, and may be embarrassing to lose costume jewelry.

It is therefore highly desirable to provide jewelry which can be worn on various parts of the body, securely. It would also be highly desirable to provide jewelry which would be more inexpensively manufactured.

It is also especially desirable to wear jewelry having an artifical stone of a heat-sensitive color-changing material on a body part other than the fingers, since fingers tend to be more exposed to weather conditions and tend to change temperature more than other body parts.

SUMMARY OF THE INVENTION

It is therefore an object of the invention to provide a new kind of jewelry.

It is another object of the invention to provide jewelry which can be worn attached to the skin of the wearer.

It is still another object of the invention to provide a new kind of jewelry which eliminates the need of relatively expensive settings, pins, rings, or the like.

It is still another object of the invention to provide a new kind of jewelry which can be securely worn in the navel or on a cheek, arm, or thigh, or on the forehead or abdomen, or another body part attached to the skin of the wearer.

It is another object of the invention to provide jewelry which can be worn attached to the skin of the wearer and which will remain attached to the skin of the wearer throughout ordinary, daily movements of the body part to which the jewelry is attached.

In the broader aspects of the invention, there is provided jewelry having a decorative portion which has a decorative front side and a non-decorative back side. A flexible and resilient pad secured to the back side of the decorative portion and a suitable adhesive applied to the exposed surface of the pad.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings wherein.

DESCRIPTION OF THE SPECIFIC EMBODIMENT

Figure 1:
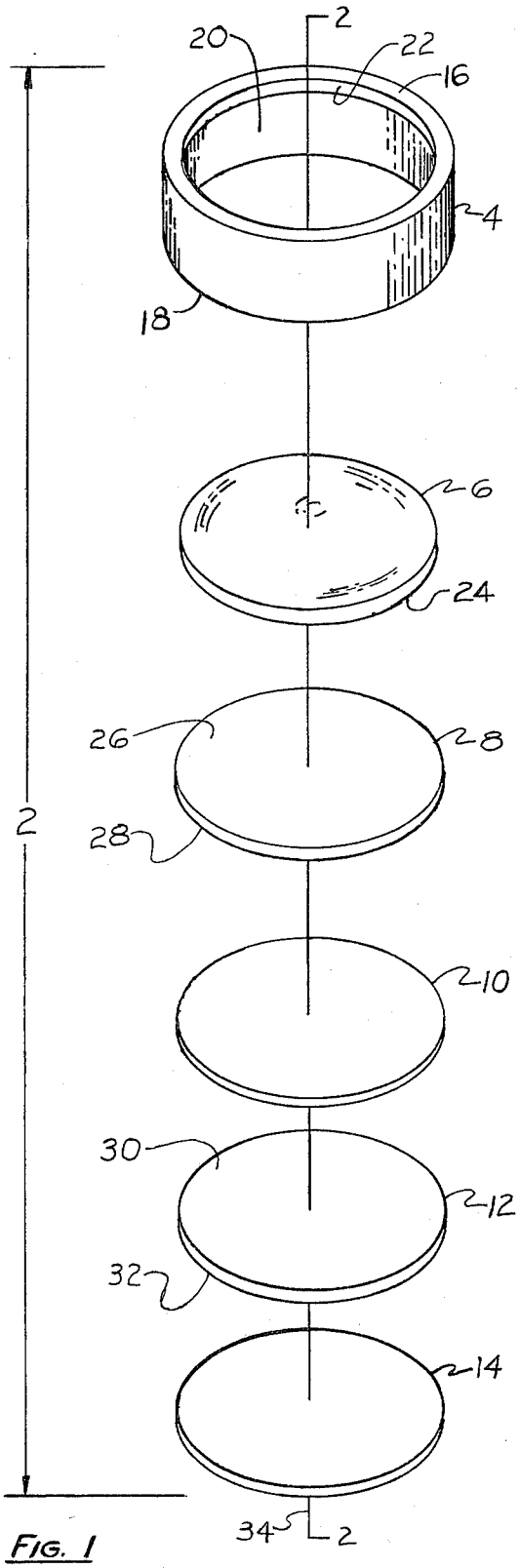
FIG. 1 is an exploded view of the jewelry of the invention.

Referring to the drawings, the jewelry 2 of the invention is shown to comprise an outer retainer 4, a decorative jewel 6, which in a specific embodiment may be a precious stone or an artificial stone or other decoration, a back plate 8, a layer 10 of adhesive, a sheet 12 of flexible and resilient material, and a second layer 14 of adhesive.

Retainer 4 has opposite ends 16, 18 and an opening 20 extending entirely through the retainer 4 between the ends 16, 18. Adjacent end 16 is a jewel retaining lip 22 which entirely surrounds opening 20. Lip 22 restricts the size of the opening 20 adjacent end 16, whereas opening 20 is unrestricted otherwise and adjacent end 18.

Jewel 6 has a generally flat back side 24 and when viewed normally to the back side 24 has a shape geometrically similar to the opening 20 of the retainer 4. The size of the jewel 6 measured in the plane of the back side 24 is slightly smaller than the opening 20 such that the jewel 6 can be fitted within the retainer 4, but slightly larger than opening 20 adjacent end 16 as restricted by the lip 22 such that the jewel 6 cannot pass through the lip 22. By this means, jewel 6 can be placed within retainer 4 and snugly held therein by urging jewel 6 against the lip 22.

Back plate 8 accomplishes the purpose of retaining jewel 6 within the retainer 4. Back plate 8 is shown to be a sheet of relatively thin material having opposite surfaces 26 and 28. When viewed normally to either surface 26 or 28, back plate 8 has a shape similar to opening 20 in retainer 4. As measured in the plane of either surface 26 or 28, back plate 8 has a size slightly larger than the un-restricted portion of opening 20, such that back plate 8 can be positioned in opening 20 of retainer 4 and frictionally secured therein. By placing jewel 6 in retainer 4 and frictionally securing back plate 8 in retainer 4 with jewel 6 snugged between lip 22 and sheet 8, jewel 6 can be securely mounted in retainer 4.

Figure 2:
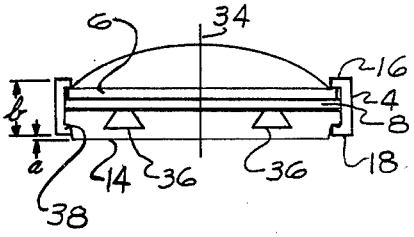
FIG. 2 is a sectional view of the jewelry illustrated in FIG. 1 taken along the section line 2—2.

Sheet 12 of flexible and resilient material is sized and shaped generally like back plate 8, and has opposite surfaces 30 and 32. Sheet 12 is secured to back plate 8 with surface 28 of back plate 8 being contiguous to surface 30 of sheet 12. Various means of attaching sheet 12 to back plate 8 can be used. In the specific embodiment illustrated in FIG. 1, a layer of adhesive 10 is positioned between surfaces 28 and 30 and sheet 12 is adhesively secured to back plate 8. Various mechanical means of attaching back plate 8 to sheet 12 are also useful including providing back plate 8 with integral protrusions 36 about which sheet 12 could be molded. Also, retainer 4 adjacent end 18 could be rolled to form a retaining lip 38 which would engage sheet 12 between surfaces 30 and 32. See FIG. 2.

As illustrated in the drawings, retainer 4, jewel 6, back plate 8, and sheet 12 are each positioned on the same axis 34. Back plate 8 is superposed on back side 24 of jewel 6. Sheet 12 is superposed on surface 28 of back plate 8, thus forming a lamination which is for the most part enclosed in retainer 4. It is essential, however, that a small portion "a" of sheet 12 extend from retainer 4 and beyond end 18, such that surface 32 of sheet 12 is exterior of retainer 4. See FIG. 2. Thus, retainer 4 must have an axial length "b" slightly smaller than the thickness dimension, taken in an axial direction, of the portions of jewel 6, back plate 8, and sheet 12 which are in retainer 4.

An adhesive layer 14 is applied to surface 32 of sheet 12. Adhesive layer 14, as will be mentioned hereinafter is that which adheres the jewelry 2 of the invention to the skin of the wearer.

In the specific embodiment in which the jewel 6 is made of a heat-sensitive, color-changing material, back plate 8 and sheet 12 and adhesive 14, all, preferably, have a high thermal conductivity. In a specific embodiment, the jewel 6 is made of a clear polyester type S material having a temperature-color sensitive range of from about 80° F. to about 90° F., back plate 8 is made of metal (copper being preferred) and sheet 12 is made of a closed cell foam material and as thin as possible. Any commercially available highly durable, flexible and resilient closed cell foam material can be used.

In a specific embodiment, an elastic surgical adhesive tape material having a waterproof adhesive layer on both sides thereof, such as fast-stick elastic double sided adhesive tape, as sold by Vapon Company of Indianapolis, Indiana, can be used in place of sheet 12 and adhesive layer 14. In this embodiment, the adhesive on one side can be used to secure the tape to surface 28 of back plate 8, and the adhesive on the other side can be used to adhere the jewelry to the skin of the wearer. Such tape has both enough flexibility and resiliency to securely adhere the jewelry to the skin of the wearer, and yet, is thin enough such that good heat transfer from the body of the wearer to the jewel 6 is achieved.

In all embodiments, adhesive 14 is a waterproof, non-allergenic adhesive such as that conventionally used on adhesive bandages.

In the specific embodiment illustrated, the retainer 4 is annular and the opening 20 therein is cylindrical in shape. Similarly, the shape of jewel 6, back plate 8 and sheet 12 are all generally "disc-shaped". However it should be understood that the jewelry of the invention can have a number of different shapes and sizes.

The jewelry of the invention as above described is worn on the skin of the wearer. The adhesive layer 14 adheres the flexible and resilient material of sheet 12 to the skin of the wearer. By the flexible and resilient nature of this material, sheet 12 can move and flex with the movement of the skin of the part of the body to which the jewelry is attached. By properly choosing the adhesive of adhesive layer 14, the jewelry can only be removed by stripping the jewelry from the skin when desired.

The resilient and flexible material of sheet 12 is securely attached to the remaining portions of the jewelry 2 of the invention as above described. Thus, the jewelry of the invention can be worn, whether it be on the cheek, the forehead, the arm, the abdomen, in the navel, or on the thigh, without fear of losing the jewelry even when the part of the body is moved so as to flex the skin, stretch the skin, wrinkle the skin or the like.

Further, the jewelry of the invention can be made relatively inexpensively inasmuch as expensive settings and the like are eliminated. Clearly, the most expensive portion of the jewelry of the invention is the jewel 6. The retainer 4 can be made of plastic or any metal which will not tarnish easily, inexpensively in accordance with conventional methods. Both the back plate 8 and the sheet 12 can be stamped from sheet materials. Thus, the disadvantages of normal jewelry are eliminated.

In the embodiment in which jewel 6 is made of a heat-sensitive color-changing material such that the jewel 6 of the jewelry of the invention changes color in response to the amount of body heat transferred to the jewel 6 from the body, is highly appropriate that the proper amount of heat be transferred from the body. In this embodiment, the heat can be transferred through the adhesive layer 14, through the sheet 12, the back plate 8 to the jewel 6. Heat can also be transferred through the retainer 4, directly to the jewel 6. In response to the amount of heat transferred, the jewel 6 when made of the aforementioned Polyester type S material, will change color from a black through a grey through a yellow through a green through a blue green through a blue to a dark blue; the jewel 6 being black when the least amount of heat is transferred and the jewel is the coldest, say below about 80° F., and be dark blue when the most amount of heat is transferred and the jewel 6 is the warmest, say above about 90° F. It is alleged that the colors reflect the mood of the person wearing the jewelry 2 as follows:

Black: Frigid
Grey: Irritable
Yellow: Melancholy
Green: Cuddly
Blue Green: Amorous
Blue: Sensuous
Dark Blue: Passionate The jewel 2 provides a new kind of jewelry which can be made relatively inexpensively when compared to rings, brooches and conventional jewelry. Jewelry can either be decorated with precious stones or can be costume jewelry or the like. The jewelry 2 is a new kind of jewelry which can be worn attached to the skin of the wearer. The jewelry 2 can be worn for example, in the navel, on a cheek, arm, thigh, or on the forehead or abdomen, or other body parts attached to the skin of the wearer. By the novel means of attachment disclosed and claimed herein the jewelry is securely attached to the skin of the wearer. By the resilient and flexible nature of the sheet 12, the flexing, wrinkling, or stretching of the skin is absorbed by the resiliency and flexibility of the sheet 12, a slight impact on the jewel itself and if the adhesive of adhesive layer 14 is properly chosen, even heavy perspiration will not cause the jewelry to become dislodged, unintentionally. When the jewel 6 of the jewelry 2 of the invention is made of a heat sensitive, color-changing material, jewelry 2 will change color depending upon the amount of heat transferred from the wearer. Because the jewelry is worn on the skin of the wearer rather than on a finger as a conventional "mood ring" is worn, better transfer of body heat to the jewel 6 is achieved than experienced with a conventional "mood ring".

While there have been described above the principles of this invention in connection with specific apparatus, it is to be clearly understood that this description is made only by way of example and not as a limitation to the scope of the invention.

What is claimed is:

1. Decorative jewelry which can be worn on the skin of the wearer comprising a rigid decorative portion having a decorative front side and a non-decorative back side, a sheet of resilient and flexible material, said sheet having a resiliency and flexibility generally the same as the human skin, said sheet having an exposed surface facing away from said decorative portion, means for attaching said sheet to the back side of said decorative portion, a layer of adhesive on said exposed surface of said sheet, said decorative portion and sheet having edges extending generally perpendicularly from portions of said front and back sides and said exposed surface, said means comprising a rigid retainer covering said edges and a portion of said decorative front side, a back plate secured to said retainer, said decorative portion being snugged between said retainer and said back plate, means for securing said sheet to said back plate, at least a portion of said sheet and said adhesive layer being outside of said retainer.

2. The jewelry of claim 1 wherein said securing means comprises a layer of adhesive between said sheet and said back plate.

3. The jewelry of claim 1 wherein said securing means and said sheet and adhesive layer comprise a resilient, flexible, elastic sheet having an adhesive layer applied to both sides thereof, one layer of adhesive securing said resilient and flexible sheet to said back plate.

4. The jewelry of claim 1 wherein said decorative portion comprises a stone.

5. The jewelry of claim 1 wherein said decorative portion is made of a heat-sensitive, color-changing material.

6. Decorative jewelry which can be worn on the skin of the wearer comprising a rigid decorative portion having a decorative front side and a non-decorative back side, a sheet of resilient and flexible material, said sheet having an exposed surface facing away from said decorative portion, means for securely attaching said sheet to said back side of said decorative portion, and a layer of adhesive on said exposed surface of said sheet, said decorative portion and sheet have edges extending generally perpendicularly from portions of said front and back sides and said exposed surface, said means comprising a rigid retainer covering said edges and a portion of said decorative front side, a back plate secured to said retainer, said decorative portion being snugged between said retainer and said back plate, means for securing said sheet to said back plate, at least a portion of said sheet and said adhesive layer being outside of said retainer.

* * * * *